US008579581B2

(12) United States Patent
Tallman

(10) Patent No.: US 8,579,581 B2
(45) Date of Patent: Nov. 12, 2013

(54) ABRADABLE BUCKET SHROUD

(75) Inventor: James Albert Tallman, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 534 days.

(21) Appl. No.: 12/882,311

(22) Filed: Sep. 15, 2010

(65) Prior Publication Data

US 2012/0063881 A1 Mar. 15, 2012

(51) Int. Cl.
*F01D 11/00* (2006.01)

(52) U.S. Cl.
USPC ..... 415/173.4; 415/174.4

(58) Field of Classification Search
USPC ..... 415/170.1, 173.1, 173.4, 173.5, 173.6, 415/174.4, 174.5; 416/174
See application file for complete search history.

(56) References Cited

U.S. PATENT DOCUMENTS

| | | | | |
|---|---|---|---|---|
| 6,660,405 | B2 | 12/2003 | Lau et al. | |
| 6,887,528 | B2 | 5/2005 | Lau et al. | |
| 6,916,529 | B2 | 7/2005 | Pabla et al. | |
| 7,500,824 | B2 | 3/2009 | Cheng et al. | |
| 7,600,968 | B2 | 10/2009 | Nelson et al. | |
| 7,614,847 | B2 | 11/2009 | Nelson et al. | |
| 2003/0175116 | A1 * | 9/2003 | Le Biez et al. | 415/173.4 |
| 2005/0003172 | A1 * | 1/2005 | Wheeler et al. | 428/210 |
| 2006/0110248 | A1 * | 5/2006 | Nelson et al. | 415/173.4 |

* cited by examiner

*Primary Examiner* — Edward Look
*Assistant Examiner* — Maxime Adjagbe
(74) *Attorney, Agent, or Firm* — Ann M. Agosti

(57) ABSTRACT

The present application provides an abradable bucket shroud for use with a bucket tip so as to limit a leakage flow therethrough and reduce heat loads thereon. The abradable bucket shroud may include a base and a number of ridges positioned thereon. The ridges may be made from an abradable material. The ridges may form a pattern. The ridges may have a number of curves with at least a first curve and a second curve and with the second curve having a reverse camber shape.

19 Claims, 2 Drawing Sheets

ABRADABLE BUCKET SHROUD

TECHNICAL FIELD

The present application relates generally to gas turbine engines and more particularly relates to an optimal shape for an abradable pattern on a bucket shroud for use in a gas turbine engine and the like.

BACKGROUND OF THE INVENTION

Generally described, the efficiency of a gas turbine engine tends to increase with increased combustion temperatures. Higher combustion temperatures, however, may create a variety of problems relating to the integrity, metallurgy, and life expectancy of the components within the hot combustion gas path and elsewhere. These problems are an issue particularly for components such as the rotating buckets and the stationary turbine shrouds positioned in the early stages of the turbine.

High turbine efficiency also requires that the buckets rotate within the turbine casing or shroud with minimal interference so as to prevent unwanted "leakage" of the hot combustion gas over the tips of the buckets. The need to maintain adequate clearance without significant loss of efficiency is made more difficult by the fact that centrifugal forces cause the buckets to expand in an outward direction towards the shroud as the turbine rotates. The bucket tips may erode, however, if the bucket tips rub against the shroud. Such erosion may cause increased clearances therebetween as well as reduced component lifetime. Other causes of leakage include thermal expansion and even aggressive maneuvering of the engine in, for example, military applications and the like.

Abradable coatings have been applied to the surface of the turbine shroud to help establish a minimum or optimum clearance between the shroud and the bucket tips, i.e., the bucket tip gap. Such a material may be readily abraded by the tips of the buckets with little or no damage thereto. As such, bucket tip gap clearances may be reduced with the assurance that the abradable coating will be sacrificed instead of the bucket tip material.

In addition to allowing for the tip-shroud contact, the use of an abradable surface as a pattern of ridges and the like thereon has been found to provide additional aerodynamic benefits in further reducing the leakage flow therethrough. Specifically, the ridges may provide direction to the mainstream flow away from the tip clearance gap. Known abradable patterns thus have been found to provide aerodynamic benefits in the reduction of the minimum tip clearance height and otherwise.

There is thus a desire for an improved abradable bucket shroud pattern so as to reduce the leakage flow through the bucket tip gap and elsewhere. Such an abradable bucket shroud pattern may be optimized for a specific bucket design in terms of the leakage flow therethrough and the heat loads thereon. Specifically, such a bucket shroud design would provide an adequate abradable shroud surface in the context of a flow reducing pattern for improved performance.

SUMMARY OF THE INVENTION

The present application thus provides an abradable bucket shroud for use with a bucket tip so as to limit a leakage flow therethrough and reduce heat loads thereon. The abradable bucket shroud may include a base and a number of ridges positioned thereon. The ridges may be made from an abradable material. The ridges may form a pattern. The ridges may have a number of curves with at least a first curve and a second curve and with the second curve having a reverse camber shape.

The present application further provides a method of minimizing a leakage flow through a bucket tip gap between a bucket tip and a shroud. The method may include the steps of determining a direction of the leakage flow across the bucket tip gap at a number of reference points along the bucket tip, positioning a number of abradable material ridges on the shroud, and forming the abradable material ridges into at least a first curve and second curve. The first curve may have a blockage position normal to the leakage flow at the reference points.

The present application further provides an abradable bucket shroud for use with a bucket tip so as to limit a leakage flow therethrough and reduce heat loads thereon. The abradable bucket shroud may include a base and a number of parallel ridges positioned therein. The ridges may be made from an abradable material. The ridges may include a pattern with a sinusoidal shape having at least a first curve and a second curve. The first curve may have a normal position to the leakage flow therethrough.

These and other features and improvements of the present application will become apparent to one of ordinary skill in the art upon review of the following detailed description when taken in conjunction with the several drawings and the appended claims.

DETAILED DESCRIPTION

Figure 1:
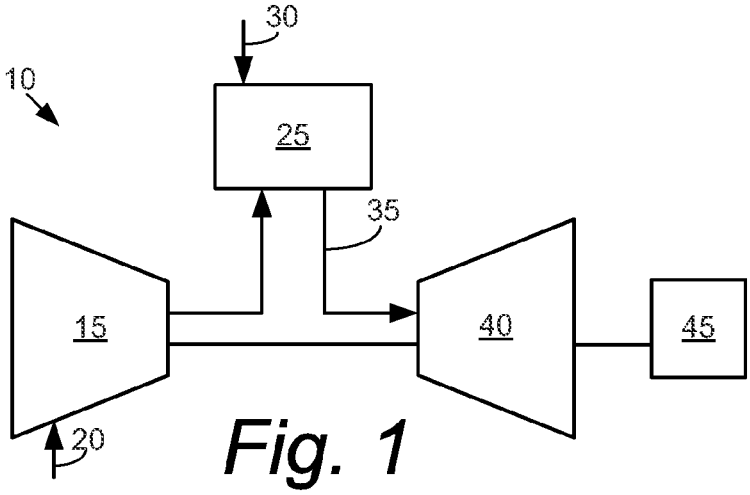
FIG. 1 is a schematic view of a gas turbine engine.

Referring now to the drawings, in which like numerals refer to like elements throughout the several views, FIG. 1 shows a schematic view of a gas turbine engine 10 as may be described herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 and an external load 45 such as an electrical generator and the like.

The gas turbine engine 10 may use natural gas, various types of syngas, and/or other types of fuels. The gas turbine engine 10 may be one of any number of different gas turbine engines offered by General Electric Company of Schenectady, N.Y. such as a heavy duty 7FA gas turbine engine and the like. The gas turbine engine 10 may have other configurations and may use other types of components. Other types of gas turbine engines also may be used herein. Multiple gas turbine engines 10, other types of turbines, and other types of power generation equipment also may be used herein together.

Figure 2:
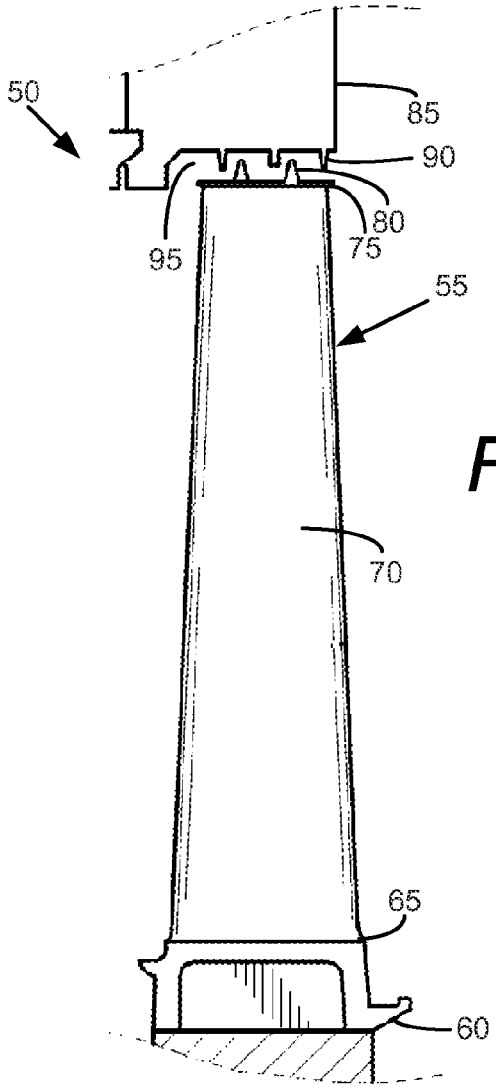
FIG. 2 is a side plan view of a known bucket and shroud of a portion of a turbine stage.

FIG. 2 shows an example of a portion of a turbine stage 50. Each turbine stage 50 includes a rotating turbine blade or bucket 55. As is known, each turbine bucket 55 may include a shank 60, a platform 65, an extended airfoil 70, and a bucket tip 75. The bucket tip 75 may have one or more cutting teeth 80 thereon. Other configurations and other types of buckets 55 may be used herein.

Each rotating bucket 55 may be positioned adjacent to a stationary shroud 85. The shroud 85 may have a number of seals 90 thereon that cooperate with the bucket tip 85 of each bucket 55. Alternatively in the case of an abradable shroud and the like, the shroud 85 may include a number of abradable ridges as will be described in more detail below. Other configurations and other types of shrouds 85 and seals 90 may be used herein.

As is known, the airfoil 70 diverts the energy of the expanding flow of combustion gases 35 into mechanical energy. The bucket tip 75 may provide a surface that runs substantially perpendicular to the surface of the airfoil 70. The bucket tip 75 thus also may help to hold the flow of combustion gases 35 on the airfoil 70 such that a greater percentage of the flow of combustion gases 35 may be converted into mechanical energy. Likewise, the stationary shroud 85 increases overall efficiency by directing the flow of combustion gases 35 onto the airfoil 70 as opposed to through a bucket tip gap 95 between the bucket tip 75 and the shroud 85. Minimizing the bucket tip gap 95 thus helps to minimize a leakage flow therethrough as is described above. Other configurations also may be used herein.

Figure 3:
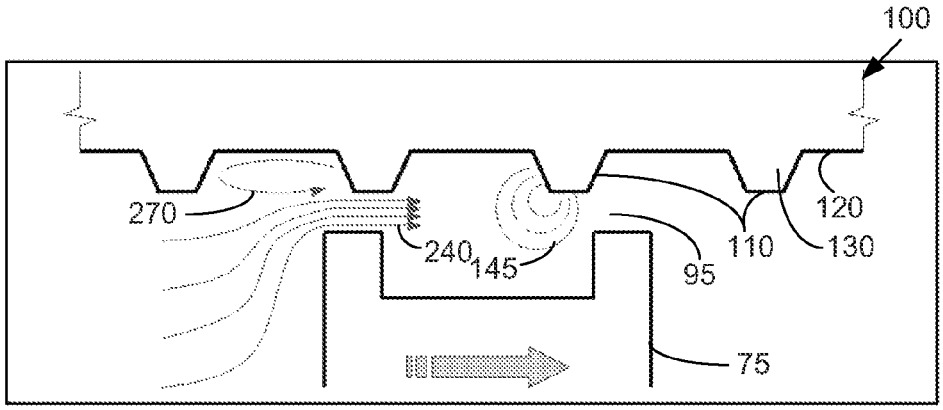
FIG. 3 is a side plan view of an abradable shroud as may be described herein positioned adjacent to a bucket tip.

FIG. 3 shows an abradable shroud 100 as may be described herein. The abradable shroud 100 may include a number of ridges 110 positioned on a base surface 120. The ridges 110 may be made out of an abradable material 130. The abradable material generally may be made out of a metallic and/or a ceramic alloy. Any type of abradable material may be used herein. The abradable material 130 also may be positioned on the base surface 120 and elsewhere.

Figure 4:
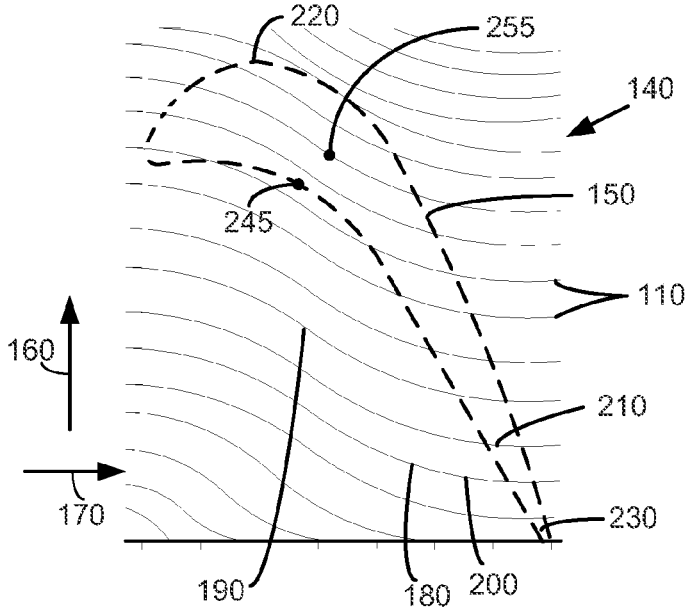
FIG. 4 is a plan view of an abradable pattern on the shroud as may be described herein with an outline of the outer surface of a turbine bucket tip shown in phantom lines across the pattern ridges.

As is shown in FIG. 4, the ridges 110 of the abradable shroud 100 may form an abradable pattern 140 thereon. A contact patch 150 with the outline of the bucket tip 75 is shown in phantom lines. An arrow 160 shows the direction of rotation of the turbine bucket 55 with respect to the abradable pattern 140. An arrow 170 indicates the direction of the flow of combustion gases 35 with respect to the abradable pattern 140.

As is shown, the ridges 110 may be substantially parallel to each other and also may be substantially equidistant. The spacing and the shape of the ridges 110, however, may vary with position. The ridges 110 may have any desired depth and/or cross-sectional shape. Other configurations may be used herein. In this example, the ridges 110 may have a substantially sinusoidal shape 180 with at least a concave or a first curve 190 followed by a convex or a second curve 200 extending from a forward portion 220 to an aft portion 230. The abradable pattern 140 thus has a double arc shape with the second curve having a reverse camber 210 shape as compared to the first curve 190. Other types of patterns may be used herein. Other types and numbers of curves may be used herein.

The abradable pattern 140 may be optimized with respect to the shape of the associated bucket tip 75. The relative positioning of the abradable shroud 100 and the bucket 55 is shown in FIG. 3 with the bucket tip gap 95 positioned therebetween. The abradable shroud 100 is stationary while the bucket 55 is rotating. The relative motion between the bucket tip 75 and the abradable shroud 100 may give rise to a timed periodic pressure pulsation 145 acting on a leakage flow 240 extending therethrough due to the passing of the pattern 140 of the ridges 110. This unsteady pressure may lead to a net reduction of the leakage flow 240 through the tip gap 95 as compared to an axially symmetric shroud with the same or a similar gap 95 therethrough. Specifically, the ridges 110 of the abradable shroud 110 combine to limit the leakage flow 240 therethrough.

Figure 5:
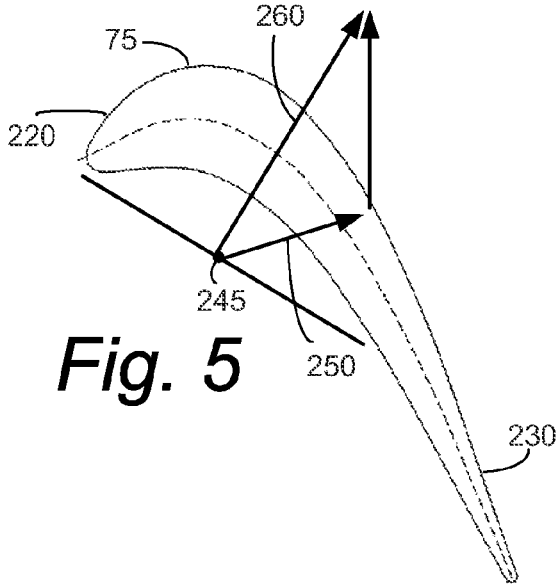
FIG. 5 is a schematic view of a bucket tip with leakage flows shown thereon.

The specific sinusoidal shape 180 or other shape of the ridges 110 may be maximized relative to the leakage flow direction. For example, FIG. 5 illustrates the leakage flow 240 through the bucket tip gap 95. The leakage velocity vectors are shown in a frame of reference relative to the bucket tip 75. The direction of the leakage flow 240 at a mid-cord reference point 245 is illustrated with an arrow 250 at about twenty degrees (20°) from the axis of rotation. When transformed to a stationary frame of reference, the leakage flow 240 is seen at an arrow 260 at an angle of about fifty-five degrees (55°). A stationary ridge 110 oriented at about negative thirty-five degrees (−35°) thus will be at a normal or a blockage position 265 to the leakage flow path 95. Such a blockage position 265 thus may provide the maximum blockage angle as the ridge 110 moves relative to the tip gap 95. This process then may be repeated at several reference points 245 along the length of the bucket tip 75 to create the shape of at least the first curve 190 of the pattern 140. Many different patterns 140 thus may be formed based upon this process based upon the type of bucket, the type of turbine, specific operating conditions, and other variables.

For example, the angle of the leakage flow 240 varies with the axial position within the tip gap 95. As such, the optimum blocking angle also may vary along the length of the bucket tip 75. The sinusoidal shape 180 of FIG. 4 thus maximizes the optimum blocking angle given the shape of the specific bucket tip 75 along the length thereof. The abradable pattern 140 thus has the concave or the first curve 190 on the forward portion 220 thereof and the convex or the second curve 200 of the reverse camber 210 on the aft portion 230. Again, many different patterns 140 thus may be formed herein.

The overall shape of the pattern 140 in general, and the double arc shape or the reverse camber 210 about the aft portion 230 in specific, also act to reduce the heat loads on the overall shroud 100. Specifically, all of the ridges 110 increase heat transfer because they have more wetted surface area. The pattern 140 may be optimized such that the first curve 190 about the forward portion 320 provides improved blocking while the second curve 200 or the reverse camber 210 about the aft portion 230 prevents overheating. In addition to blocking the leakage flow 240 therethrough, the ridges 110 also may establish an optimum recirculation flow 270 between adjacent ridges 110. This inter ridge recirculation flow 270 may be made up of cool air that may be retained between adjacent buckets 55. The pattern 140 thus balances leakage reduction with reduced heat transfer.

The abradable shroud 100 with the abradable pattern 140 thus limits the leakage flow 240 therethrough and the issues associated therewith such as aerodynamic performance degradation and increased shroud heat loads. Specifically, the abradable pattern 140 may be optimized with respect to the leakage flow 240 passing over the bucket tip 75 and the overall heat transfer. Other types of abradable patterns 140 may be used with other types and shapes of bucket tips. As compared to a shroud without a pattern thereon, the abradable shroud 100 described herein is noticeably cooler and provides less leakage flow 240 therethrough about the forward portion 320 thereof. The aft portion 230 may be somewhat warmer, but less warm than it would otherwise be with similar leakage flows therethrough.

The reduction in the leakage flow 240 thus reduces the aerodynamic losses about the bucket 55 and the shroud 100 so as to provide higher efficiency. Likewise, the thermal load on the shroud 100 may be reduced so as to improve overall durability and component lifetime.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. An abradable bucket shroud for use with a bucket tip so as to limit a leakage flow therethrough and reduce heat loads thereon, comprising:

a base; and a plurality of ridges positioned thereon;

wherein the plurality of ridges comprises an abradable material;

wherein the plurality of ridges comprises a pattern;

wherein each of the plurality of ridges comprises a plurality of curves;

wherein the plurality of curves comprises at least a first curve and a second curve; and wherein the first curve comprises a plurality of blockage positions, each normal to a direction of the leakage flow at the respective position and wherein the second curve comprises a reverse camber shape.

2. The abradable bucket shroud of claim 1, wherein the first curve and the second curve comprise a sinusoidal shape.

3. The abradable bucket shroud of claim 1, wherein the first curve comprises a concave shape.

4. The abradable bucket shroud of claim 1, wherein the second curve comprises a convex shape.

5. The abradable bucket shroud of claim 1, wherein the bucket tip comprises a forward portion and an aft portion and wherein the first curve is positioned about the forward portion and the second curve is positioned about the aft portion.

6. The abradable bucket shroud of claim 1, wherein the plurality of ridges are substantially parallel.

7. The abradable bucket shroud of claim 1, wherein the plurality of ridges are substantially equidistant.

8. The abradable bucket shroud of claim 1, wherein the first curve comprises a plurality of reference points and wherein the first curve comprises a maximized blockage position at each of the plurality of reference points.

9. The abradable bucket shroud of claim 1, wherein the plurality of ridges comprises a recirculation flow therebetween.

10. A method of minimizing a leakage flow through a bucket tip gap between a bucket tip and a shroud, comprising:

obtaining a direction of the leakage flow across the bucket tip gap at a plurality of reference points along the bucket tip;

positioning a plurality of abradable material ridges on the shroud to provide a plurality of blockage positions, each comprising at least a first curve comprising a blockage position normal to the leakage flow at a respective one of the plurality of reference points and a second curve comprising a reverse camber shape with respect to the first curve.

11. The method of claim 10, wherein the step of positioning a plurality of abradable material ridges on the shroud comprises positioning a plurality of parallel abradable material ridges on the shroud.

12. The method of claim 10, wherein the step of positioning a plurality of abradable material ridges on the shroud comprises positioning a plurality of equidistant abradable material ridges on the shroud.

13. The method of claim 10, wherein the step of forming the plurality of abradable material ridges into a first curve and a second curve comprises forming the plurality of abradable material ridges into a sinusoidal shape.

14. The method of claim 10, wherein the step of forming the plurality of abradable material ridges into a first curve and a second curve comprises forming the plurality of abradable material ridges into a first curve with a concave shape and a second curve with a concave shape.

15. The method of claim 10, further comprising the steps of rotating the bucket tip and forming a pressure pulsation about the plurality of abradable material ridges.

16. The method of claim 10, further comprising the steps of rotating the bucket tip and forming a recirculation flow between each of the plurality of abradable material ridges.

17. The method of claim 10, wherein the step of forming the plurality of abradable material ridges into a first curve and second curve comprises forming at least the first curve into the blocking position and forming the second curve into a cooling position.

18. An abradable bucket shroud for use with a bucket tip so as to limit a leakage flow therethrough and reduce heat loads thereon, comprising:

a base; and a plurality of parallel ridges positioned thereon;

wherein the plurality of ridges comprises an abradable material;

wherein the plurality of ridges comprises a pattern with a sinusoidal shape extending along a horizontal direction representing direction of a flow of combustion gases with respect to the pattern, having at least a first curve and a second curve; and wherein the first curve comprises a blockage position to the leakage flow therethrough.

19. The abradable bucket shroud of claim 18, wherein the second curve comprises a position configured to reduce transfer of heat to the leakage flow therethrough.

* * * * *

UNITED STATES PATENT AND TRADEMARK OFFICE

CERTIFICATE OF CORRECTION

PATENT NO. : 8,579,581 B2
APPLICATION NO. : 12/882311
DATED : November 12, 2013
INVENTOR(S) : Tallman It is certified that error appears in the above-identified patent and that said Letters Patent is hereby corrected as shown below:

In the Specification

In Column 3, Line 14, delete “bucket tip 85” and insert -- bucket tip 75 --, therefor.

In Column 4, Line 10, delete “abradable shroud 110” and insert -- abradable shroud 100 --, therefor.

In the Claims

In Column 6, Line 26, in Claim 14, delete “concave” and insert -- convex --, therefor.

Signed and Sealed this
Twenty-second Day of April, 2014

Michelle K. Lee

Michelle K. Lee
*Deputy Director of the United States Patent and Trademark Office*